United States Patent [19]

Gazda

[11] 4,018,277

[45] Apr. 19, 1977

[54] SELECTIVE BOMB HANGER

[75] Inventor: Imre I. Gazda, Saginaw, Tex.

[73] Assignee: Otis Engineering Corporation, Dallas, Tex.

[22] Filed: May 17, 1976

[21] Appl. No.: 687,191

[52] U.S. Cl. ..... 166/214
[51] Int. Cl.² ..... E21B 23/00
[58] Field of Search ..... 166/136, 214, 137, 217

[56] References Cited

UNITED STATES PATENTS

| | | | |
|---|---|---|---|
| 2,401,119 | 5/1946 | Taylor, Jr. | 106/137 |
| 2,605,843 | 8/1952 | Baker | 166/137 |
| 3,297,083 | 1/1967 | Taylor | 166/214 |
| 3,446,281 | 5/1969 | Watkins | 166/214 |

*Primary Examiner*—James A. Leppink
*Attorney, Agent, or Firm*—Warren H. Kintzinger

[57] ABSTRACT

A well tubing hanger for suspending a pressure bomb, and/or temperature recording device or other equipment, in the tubing, from a selected tubing nipple, through a test period. It is a bomb hanger such that when the suspended equipment is in use for test surveys, the wire line used to run the tools is not left in the well, thereby achieving considerable savings, particularly when a plurality of wells in a field are surveyed. Hanger locking lugs are shifted radially outwardly into a position-selected matching nipple recess when brought into operational alignment therewith, after lug latch members have been released by unlocking upward movement engagement with a tubing nipple shoulder. A lug-locking sleeve is movable into lug locking position with the sleeve lockable by a ball recess lock interference fit. A resiliently-displaceable plunger structure permits a recess relief unlock for the balls, from the ball recess lock interference fit, and thereby permits unlock release movement of the tubular sleeve with the tool fishing neck for unlocking the locking lugs from the extended state.

30 Claims, 8 Drawing Figures

SELECTIVE BOMB HANGER

Figures 1, 2, 3:
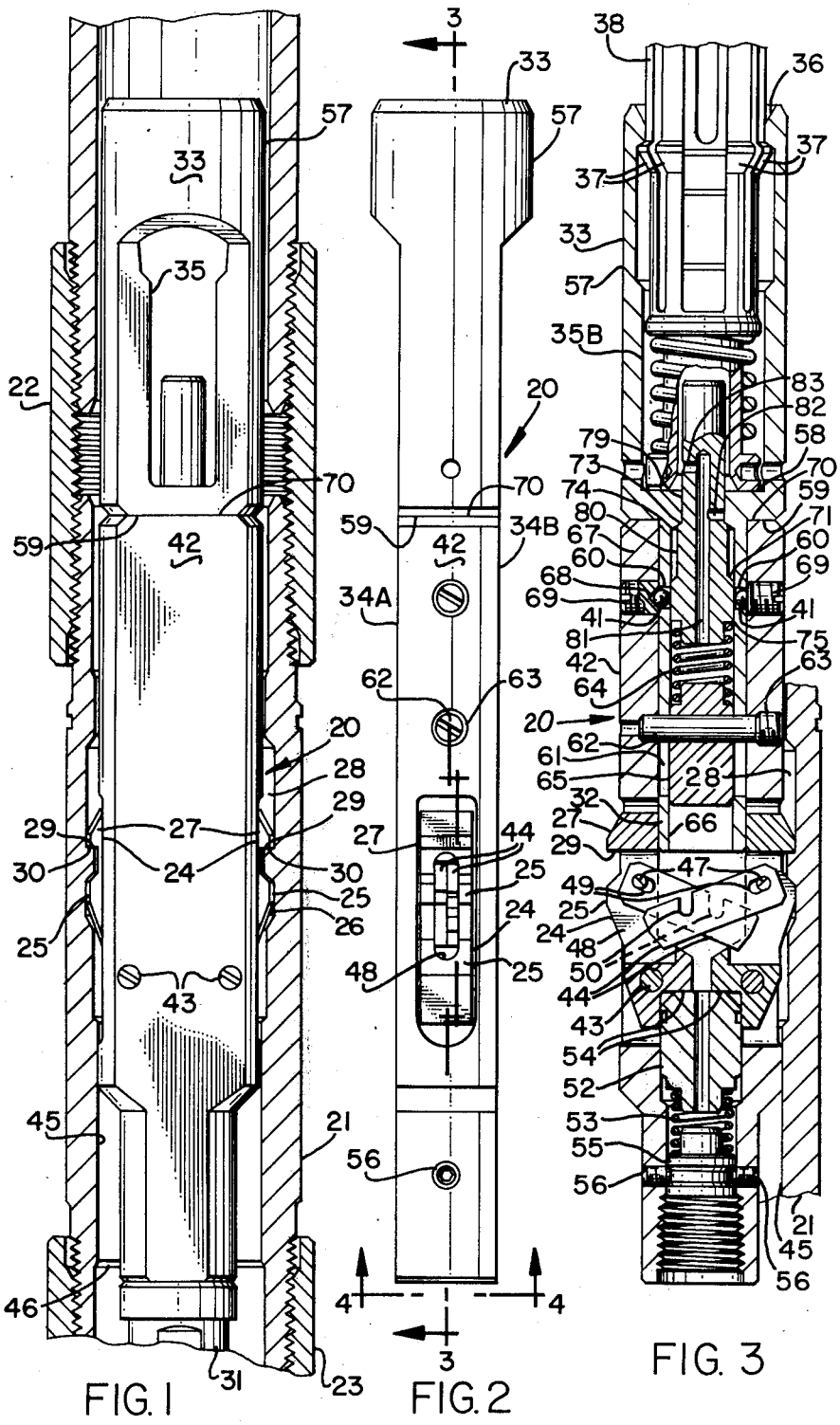

This invention relates in general to well tools, and in particular to an improved well tubing hanger in the form of a self-contained selective bomb hanger generally used for suspending sensing equipment, such as a pressure bomb for pressure surveys, in well tubing.

In wells drilled for recovery of oil and/or gas, various tools such as pressure and/or temperature survey tools are suspended from hangers (i.e., bomb hangers) when wireline used to run the tools is not left in the hole. This feature is particularly useful with well producers requiring extended, drawdown or buildup, bottom hole pressure surveys, with a lug type bomb hanger suspending the pressure and/or temperature bomb in the tubing during the test. Such bomb hanger usage results in substantial savings, as opposed to methods wherein wireline is left in the hole through a measuring test time period; particularly is several wells are to be surveyed. Obviously, it is important that a bomb hanger be left in a well only if it is properly set in the well, and usage is enhanced if, for example, a selective bomb hanger is settable in a standard well tubing nipple-and, further, if it is settable in a selected nipple, if there are more nipples than one in a tubing string. In addition, bomb hanger structure should permit optimized bypass flow and should facilitate the lowering of the structure through fluid, down the well. Also important is that wireline-run selective bomb hangers be lockable in place through utilization of the weight of the tool string, and that the hanger can be removed without jarring.

It is therefore a principal object of this invention to provide a downwell nipple-selective equipment hanger, capable of being locked in place and removed without jarring sensitive tools and equipment supported by the hanger.

Another object is to provide such a nipple selective hanger lockable in place through utilization of tool-string weight.

A further object is to provide such a nipple-selective hanger, configured for optimized fluid bypass flow when locked in place, and for facilitating lowering, through fluid, down the well.

Still another object is to provide a nipple-selective hanger, settable in a selected standard well tubing nipple that is left in the well, with wireline and running tool removed only if properly set.

Features of this invention useful in accomplishing the above objects include, in a nipple-selective hanger (i.e., bomb hanger), a hanger unit that is wireline-run with a disengageable running tool until it is positioned with the hanger lugs fully engaged in a selected tubing nipple. Then, with some additional play out of wireline, the weight of the running tool shifts a fishing neck member of the bomb hanger downward in the hanger structure, against resilient resistive force of an internal spring member, through a finite range of movement, until lock position balls are cammed outwardly into ball-retainer seats, as a lock plunger member is spring-urged upward into a lock-retaining state. The selective bomb hanger is equipped with a latch and latch pin structure that holds the hanger lugs in the retracted state as the hanger is lowered down the well. The latch and latch pin structure is arranged to be disengaged, for hanger lug release, by latch disengagement release contact with a tube shoulder as the hanger is raised to achieve lug release preparatory to lug setting in a selected nipple recess that generally is above the latch and lug releasing tube shoulder. A resiliently biased plunger presses the lug members about pivotable mountings for lug movement outward and for nipple recess setting. After the bomb hanger is properly set in place, the wireline with sufficient lifting force disengages the running tool from the fishing neck of the selective bomb hanger, which remains set in place in the well. When the bomb hanger and hanger-suspended tooling are to be removed from the well, a pulling tool, lowered by wireline, presses the lock member downward against the resilient force of a spring member. The lock plunger is moved down until the lock position balls cam out of the ball-retainer lock seats, with upward movement of the fishing neck member, to a position permitting inward camming withdrawal of the lugs, from the outward position lock position. Then the pulling tool, that is latch-engaged in the fishing neck by upward pulling of the wireline, pulls the bomb hanger and the hanger-suspended tooling up the well.

A specific embodiment representing what is presently regarded as the best mode for carrying out the invention is illustrated in the accompanying drawings.

Figure 5:
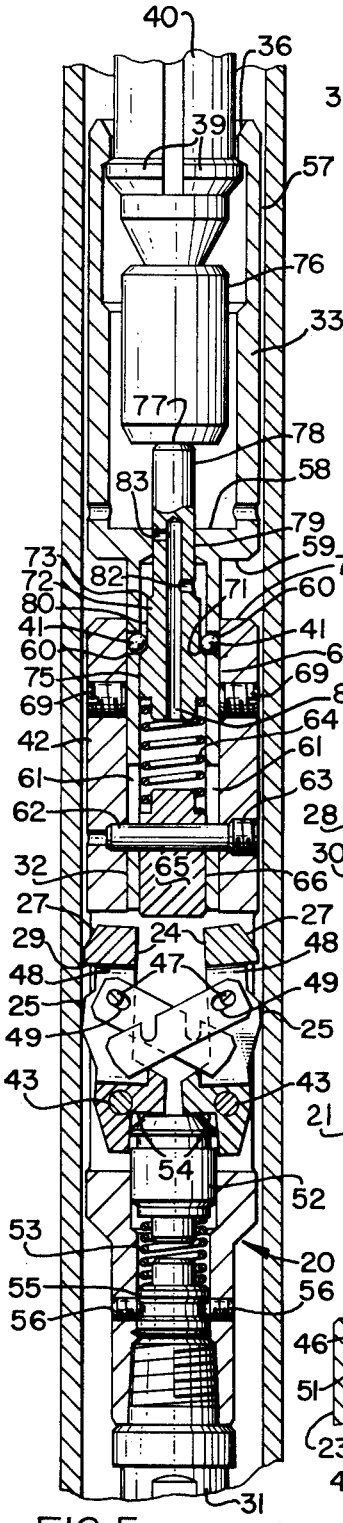
Figure 4:
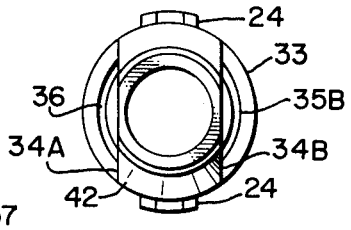
Figure 6:
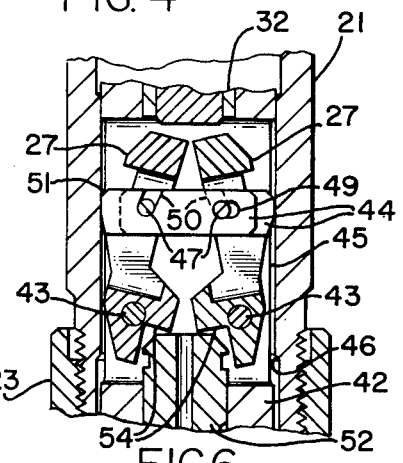
Figure 7:
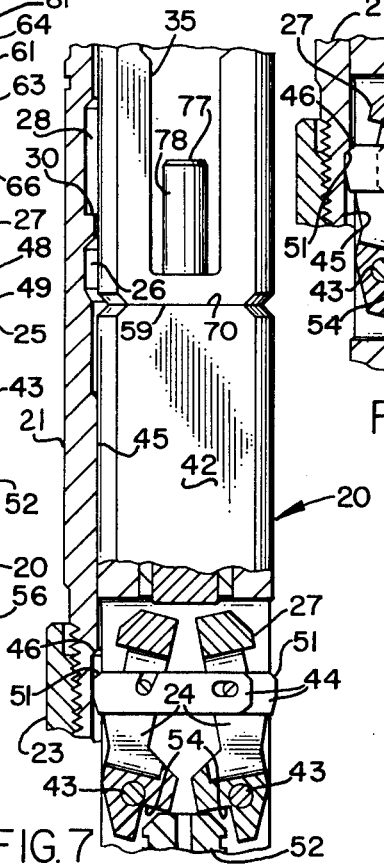
Figure 8:
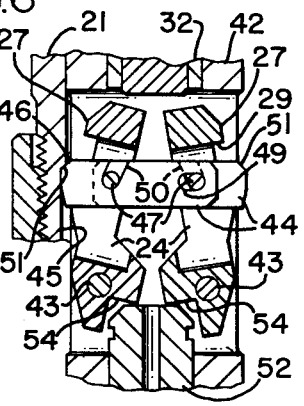

In the drawings:

FIG. 1 represents a side elevation view, with well tubing and nipple broken away and sectioned, of a selective bomb hanger set in place in a tubing nipple;

FIG. 2, a side elevation view of the selective bomb hanger of FIG. 1, by itself, rotated 90°;

FIG. 3, a side elevation view of applicant's selective bomb hanger, in section, substantially along line 3—3 of FIG. 2, with a running tool still inserted into the fishing neck of the bomb hanger and with lugs lock-extended;

FIG. 4 a bottom view of the bomb hanger, looking upward from line 4—4 of FIG. 2;

FIG. 5, a side elevation, sectioned view, much like FIG. 3, with a wireline pulling tool inserted in the fishing neck of the bomb hanger, however, and with lugs retracted for retreival removal of the bomb hanger and the tool string suspended therefrom;

FIG. 6, a partial side elevation, sectioned view, showing primarily the lug and lug latch section of the selective hanger in the unlatched state as the hanger is lowered down the well;

FIG. 7, a partial side elevation view, partially in section, again showing the lug and lug latch section, with the latches in close proximity to and below an unlatching shoulder that, with raising of the hanger, unlatches the latches and the lugs; and, FIG. 8, a partial side elevation, sectioned view with latch member ends engaging an unlatching shoulder in a tubing nipple.

Referring to the drawings:

The selective bomb hanger 20 is shown in FIG. 1 to be set in a well nipple 21, threadedly interconnected between upper tubing connective member 22 and lower tubing connective member 23. In the set state shown, hanger position set lug members 24 are in the outer nipple 21 engaging state, with lower lug projections 25 projectng outward into annular nipple recess 26, and upper lug projections 27 projecting outward into annular nipple recess 28. When the selective bomb hanger 20 is thus set in the well, shoulder faces 29 of the upper lug projections 27, by resting on shoulder face 30 of annular nipple recess 28, support the weight of the hanger 20 and tooling equipment 31 supported thereby. The lower lug projections 25, in projecting into annular nipple recess 26 (and prevented from being cammed inward therefrom by lock position backing of lug members 24 with the bottom end of the tubular extension 32 of fishing neck 33, lowered in the hanger structure to the state shown in FIG. 3) lock the bomb hanger 20 from upward movement from this set state in the well. The bomb hanger 20 is also configured to optimize bypass flow of oil and/or gas, with flat sides 34A and 34B and openings 35, through opposite sides of fishing neck 33, to a center opening 35B therein extending to and through an upper end annular internal boss 36. Boss 36 is engaged by locking projections 37 of a running tool 38 such as the "Soft Set Running Tool," subject of U.S. patent application Ser. No. 647,341, filed Jan. 8, 1976, with the inventor of this case being a coinventor thereof and both cases being assigned to common assignee. The upper end, annular, internal beveled, boss 36 in fishing neck member 33 is also engaged by locking projections 39 of a wireline pulling tool 40 when upward wireline removal of the bomb hanger 20 and tool equipment 31 is undertaken. While the bomb hanger 20 is in the withdrawal state in FIG. 5, being raised by a pulling tool 40, the relative positions of the fishing neck member 33, lock position balls 41, and housing member 42, are the same as when the bomber hanger 20 is being lowered by wireline running tool 38 before lug shoulder faces 29 engage nipple shoulder face 30; after which, weight of the running tool 38 shifts the fishing neck member 33 downward relative to housing member 42. However, before lug members 24 are free to pivot outwardly about their individual dog pin 43 mountings in housing member 42, to the nipple recess engaging state of FIGS. 1 and 3, they must be unlatched from the cross-latched, inner-retracted state of FIGS. 6, 7, and 8. This latch release is accomplished by lowering of the bomb hanger 20, with the latch section including latch members 44, through a reduced diameter bore 45 in a nipple 21, and then pulling the hanger 20 back up. This is done to bring outer ends of latch members 44 into engagement wih internal annular nipple shoulder 46 at the bottom of nipple bore 45. Then, with continued upward movement of the hanger 20, latch members 44 unlatch from mutual cross-latch engagement between lug members 24, to the unlatched position, as shown in FIGS. 3 and 5.

The two latch members 44 are each mounted on a combination mounting and latch pin 47, mounted to span latch member 44 containment and clearance slots 48, in each of the lug members 24. Each latch member 44, at its mounting end, is formed with an elongated slot 49 that permits limited, relative side movement between the latch member 44 and its mounting pin 47, such as would occur as the latch section of the bomb hanger 20 is being moved down (as shown in FIG. 6) through a reduceddiameter bore 45. Each of the latch members 44 has a latch slot 50 that latch-engages the latch pin 47 mounting with the other latch member; with the slot 50 slanted inwardly, at approximately a 15° angle, to help maintain the latched slot, except when latch disengagement is desired. Latch disengagement is accomplished, after the latch section has been lowered through a bore 45, by raising the bomb hanger from the state of FIG. 7 to the state of FIG. 8, with the upper beveled corners 51 of latch members 44 brought into engagement with beveled shoulder 46 at the bottom of bore 45. Then with continued upward movement of the selective bomb hanger 20, the slots 50 of latch members 44 are disengaged from mounting and latch pins 47, to the state shown in FIG. 5. With latch members 44 latch-released, lug members 42 are resiliently urged by upward force of plunger 52, backed by resiliently compressed coil spring 53 exerted on shoulders 54 of lug members 42, and cause the lugs to pivot about the mounting pins 43 and urge lug projections 27, outward. Coil spring 53 is supported in place by stop member 55 that is fixed in place by socket-head set screws 56.

The structure with coil spring 53, resiliently urges lug projections 27, outwardly, to move into annular nipple recess, as they are brought into mutual alignment; and lower lug projections 25 are in alignment with annular nipple recess 26. It should be noted that each lug member 24 is formed with approximately a 45° bevel slope on the upper, outer corner of its lug projection 27; approximately a 45° bevel slope on the top of its lower lug projection 25; and, approximately a 30° bevel slope on the bottom of its lower lug projection 25. This facilitates camming of lug members 24 into, and out of, lug insertion in annular nipple recesses — the upward facing beveled slopes riding on upper beveled shoulders of nipple recesses (with upward movement of the bomb hanger lug member 24 section) through a nipple recess area, to above such area as is the general transitional mode in operation. Then, from above the nipple recess, the bomb hanger 20 is slowly lowered by wireline running tool 38 until lug shoulder faces 29 come to rest on nipple shoulder 30. As the lug members 24 are being lowered, the lower facing bevel of lower lug projections 25 ride over the inner edge of nipple shoulder 30. It should be noted that, after unlatch of latch members 44 and lug members 24, the bomb hanger 20 could be lowered to lug member 24, seating on a nipple shoulder 30 of a well nipple 21 that is lower in the well, if the lug projections 27 have not been raised above the nipple recess shoulder face 30, shown — such as generally occurs in the setting, in a well, of the selective bomb hanger 20. Thus, after latching-release of the lug members 24, the selective bomb hanger 20 finds the nearest, design-matched nipple profile in the down direction to which it is lowered after the raising, unlatch-motion, which motion usually carries through to above the lug seating nipple profile of that immediate area.

Fishing neck member 33 is formed to have an enlarged upper, hollow, cylindrical portion 57, within which a running tool 38 or a pulling tool 46 may be engaged, and it terminates in a bottom end having an internal bottom surface 58 and an outer shoulder 59. The tubular, downward extension 32, from the cylinder 57, is slidingly received within the upper end of hanger housing 42. The extension 32 has ball openings 60, acting as a retainer cage for lock balls 41, and is also provided with slots 61 that cooperate with a guide and limit pin 62, mounted to extend from one side to the other of the housing member 42, and with a head threaded into housing 42. Guide and limit pin 62 not only extends through slots 61 of the tube 32, it also mounts a spring 64 retainer member 65; longitudinally fixed thereby to housing 42, but slidable within internal diameter 66 of tube extension 32 as the extension is slid longitudinally back and forth within the cylindrical portion 67 of housing 42. Slots 61 in tube 32 limit the range of longitudinal movement of the fishing neck member 33 relative to housing 42, between a position limit, shown in FIG. 5, and the opposite limit set-state position (shown in FIG. 3) by contact of respective slot ends, with guide and limit pin 62. Further, the sides of tube slots 61, in sliding on opposite sides of pin 62, maintain rotational alignment of the tube 32, and fishing neck 33, with hanger housing 42. This ensures that lock position balls 41 will be delivered, for proper cammed entry, to the conical, receiving, relief openings 68, in ball retainers 69 threaded into housing 42, when the fishing neck 33 and tube 32 and shifted, down, to the lock-set-state limit position of FIG. 3— with shoulder 59 adjacent housing top 70, and with pin 62 at the top of slots 61. When this lock set state is reached, balls 41 are cammed outwardly by sloped annular cam surface 71 of lock member 72 that is resiliently urged upward by compressed coil spring 64, between the bottom of lock member 72 and the top of spring retainer member 65. Lock member 72 is carried down with tube 32, by the interlock through-balls 41, between tube 32 and member 72, via cam surface 71. Then, when balls 41 are cammed outwardly into retainer openings 68, lock member 72 shifts, upward, to a limit position, with lock member shoulder 73 pressing against internal shoulder 74 of the fishing neck 33, and with annular boss 75, in ball 41 lock-maintaining alignment. Movement of the fishing neck member 33 and tube extension 32, downward, relative to hanger housing 42 (from the relationship of FIG. 5, to the lock-set-state of FIG. 3) simultaneously utilizing the weight of the fishing neck member 33 and the running tool 38 in the tool string. This lock-sets the selective bomb hanger 20, with the bottom end of the tubular extension 32, lowered to lock position set backing of lug members 24, immediately behind upper lug projections 27.

When selective bomb hanger 20 release from the lock-set state of FIGS. 1 and 3 is desired, a pulling tool 40 with a bottom member 76 pushes down on the top 77 of the upper extension 78 of lock member 63 that extends, up-to within cylinder 57 above surface 58. Extension 78 is round, rod-extension, slidable through opening 79 in the bottom of fishing neck cylinder 57. The resulting downward movement of lock member 72 brings the reduced-diameter shank 80, on member 72 between cam surface 71 and shoulder 74, low enough to the balls 41 to be cammed out of retainer openings 68 with upward movement of tube section 32 and lock member 72, together as weight of the pulling tool 40 is lessened so resilient force of spring 64 can push the lock member 72 and tube 32, upward, together, with balls 41- to the release state of FIG. 5. In this state, lug projections 27 may be cammed from nipple recess 28, and are so shown with the selective bomb hanger 20, along with tooling 29, being raised up the well tubing. Fluid flow passage 81, extended from the bottom of lock member 72 to side openings 82 and 83, helps relieve fluid pressure build-up in internal chambers (with relative movement between bomb hanger parts).

Thus, there is hereby provided a self-contained, selective bomb hanger 20 that may lock-set in a selected, standard well nipple, of one or more nipples down a well, by up and down manipulation of the hanger, with wireline and running tool 38. Further, it is a selective bomb hanger, that may be left in the well only if it is properly lock-set, that provides maximum bypass fluid flow, and that may be removed without jarring.

Whereas this invention is herein illustrated and described with respect to a single embodiment thereof, it should be realized that various changes may be made without departing from the essential contributions to the art made by the teachings hereof.

I claim:

1. A well equipment hanger constructed for being set in a selected nipple down a well including: housing means; lug means pivotally mounted in said housing means for movement between an inner withdrawn state and an outward position; latch structure means latch holding said lug means in said inner withdrawn state and releasable from the latched state for lug means movement to said outward position; lug means outer position lock member means mounted for longitudinal sliding movement within said housing into and out of lug means outer position; interference lock means positionable for locking said lock member means from movement relative to said housing means and in position to back said lug means in said outer position; and locking member means positionable for unlock moving said interference lock means from the interference lock state to a lock release position.

2. The well equipment hanger of claim 1, including spring structure means resiliently biasing said lugs means through a range of movement from said inner withdrawn state to said outward position.

3. The well equipment hanger of claim 2, wherein said locking member means is a resiliently displaceable plunger structure; and spring means resiliently longitudinally biasing said plunger in one direction throughout its range of longitudinal movement.

4. The well equipment hanger of claim 3, wherein cooperating guide pin means and slot means guide said lock member means and limit the range of longitudinal movement of said lock member means within said housing means.

5. The well equipment hanger of claim 4, wherein said guide pin means is mounted in said housing means; said slot means is in said lock member means; and said lock member means is generally a tubular extension.

6. The well equipment hanger of claim 5, wherein said guide pin means is a single pin, mounted to extend through said slot means in the lock member means.

7. The well equipment hanger of claim 6, wherein said single pin extends through a spring retainer contained within said tubular extension.

8. The well equipment hanger of claim 3, wherein said resiliently displaceable plunger structure is slidably contained within said tubular extension.

9. The well equipment hanger of claim 5, wherein said lock member means is a tubular extension from an upper fishing neck member.

10. The well equipment hanger of claim 9, wherein said interference lock means are lock position balls in ball cage openings in a section of said tubular extension having a wall thickness of less than the diameter of said balls.

11. The well equipment hanger of claim 10, with ball recess means in said housing means.

12. The well equipment hanger of claim 11, with said plunger structure being formed with an enlarged diameter portion a snug sliding fit in the section of said tubular extension having a wall thickness of less than the diameter of said balls; a smaller diameter portion above said enlarged diameter portion; and a ball cam surface between said enlarged diameter portion and said smaller diameter portion of said plunger structure.

13. The well equipment hanger of claim 12, wherein when said lock position balls have been cammed to seat in said ball recess means in said housing means said enlarged diameter portion of said plunger structure is in position backing said balls in an outward interference lock position.

14. The well equipment hanger of claim 3, wherein said lock member means is a tubular extension of an upper end fishing neck formed with a chamber having an annular boss at the top for engagement by running tools and pulling tools; and said locking member means resiliently displaceable plunger structure includes an upper rod extension extending upward into the chamber of said fishing neck for engagement by a pulling tool and depression of the locking member means downward for interference lock means release and lock member means movement out of lug means outer position lock position for lug means release.

15. The well equipment hanger of claim 2, wherein said spring structure includes a spring confined within said housing means between said lug means and a stop structure within said housing.

16. The well equipment hanger of claim 15, wherein said spring structure includes a plunger members slidably contained within said housing between said spring and said lug means.

17. The well equipment hanger of claim 16, wherein said housing is provided with fitting structure at the bottom for connection of suspended equipment thereto.

18. The well equipment hanger of claim 1, wherein said lug means pivotally mounted in said housing means includes two lug members pivotally mounted in said housing by two pivot pins, one for each lug member.

19. The well equipment hanger of claim 18, wherein each of said two lug members is formed with a downward shoulder face on an upper lug projection that together, when the hanger is set in the well, are shaped to rest on an upper facing shoulder of an annular nipple recess and support the hanger and hanger suspended tooling in the well.

20. The well equipment hanger of claim 19, wherein the lug projection of each lug member is formed with an upper outer slope to facilitate camming of the lug member inwardly from the annular nipple recess as the hanger is being raised after unlock from the set state.

21. The well equipment hanger of claim 20, wherein each of said lug members has a middle lug projection between said upper lug projection and the lug member pivot pin mounting; and with said middle lug projection slope beveled both at the top and at the bottom to facilitate cammed entry into and out of annular nipple recesses of a multiple recessed nipple in the well tubing.

22. The well equipment hanger of claim 21, wherein said latch structure means includes a latch member pivotally mounted on one lug member; and latch engageable and disengageable interconnect means between said latch member and the second lug member; and with said latch member projecting beyond the outer profile of said housing when in the latched state for latch release when engaging a reduced diameter bore shoulder within the well tubing.

23. The well equipment hanger of claim 22, wherein said latch structure means includes two of said latch members pivotally mounted respectively on an individual one of said two lug members to project out beyond the outer profile of said housing to opposite sides thereof.

24. The well equipment hanger of claim 23, wherein said latch members are pivot pin mounted on a latch pivot pin respectively of the opposite lug members; and the latch engageable and disengageable interconnect between said latch members and the lug members is a slot of each latch member engaging a latch pin of the lug member opposite to the lug member mounting each respective lug member.

25. The well equipment hanger of claim 24, wherein the slot in each of said latch members is an upward facing slot; each of the said latch members has an elongated opening at its pivot pin mounting to a lug member to permit inward compressive transverse movement of said latch members as the hanger is being lowered through a reduced diameter bore down the well; and with the latch members being subject to latch release from latch pins upon engagement of said latch members with a shoulder at the bottom of a reduced diameter bore within well tubing with continuing upward movement of the hanger after the hanger has been lowered through such reduced diameter bore.

26. The well equipment hanger of claim 25, wherein the upward facing slot in each of the latch members has an inward slope so that resilient force exerted on the lug members, while the lug and latch members are in the latched state tends to maintain the latched state.

27. The well equipment hanger of claim 1, wherein the exterior of said housing means is formed with two parallel planar surfaces; and, extending between the two parallel planar surfaces, arcuate sections.

28. The well equipment hanger of claim 1, with said lug means positioned to extend into a tubing nipple recess when said hanger is set in a well.

29. The well equipment hanger of claim 14, wherein the exterior of said housing means if formed with two parallel planar surfaces; and, extending between the two parallel planar surfaces, arcuate sections.

30. The well equipment hanger of claim 29, wherein the exterior of said fishing neck is formed with two parallel planar surfaces so spaced as to intersect said chamber and provide free fluid communication openings from the lower exterior of said fishing neck to the interior of said chamber.

* * * * *